United States Patent [19]

Doner

[11] 4,102,322

[45] Jul. 25, 1978

[54] OVEN DOOR CONSTRUCTION

[75] Inventor: John T. Doner, Marion, Ohio

[73] Assignee: Whirlpool Corporation, Benton Harbor, Mich.

[21] Appl. No.: 696,532

[22] Filed: Jun. 16, 1976

[51] Int. Cl.[2] ..... F23M 7/04

[52] U.S. Cl. ..... 126/198; 126/200; 49/465; 52/208; 52/489

[58] Field of Search ..... 126/198, 200; 52/489, 52/498, 208; 49/465

[56] References Cited

U.S. PATENT DOCUMENTS

| | | | |
|---|---|---|---|
| 1,060,808 | 5/1913 | Alexander et al. | 126/200 |
| 2,325,773 | 8/1943 | Hennessy | 126/200 |
| 2,580,957 | 1/1952 | Reeves | 126/200 |
| 3,177,334 | 4/1965 | Kinkle | 126/200 |
| 3,877,460 | 4/1975 | Lotz et al. | 126/200 |
| 4,023,554 | 5/1977 | Katona | 126/198 |

*Primary Examiner*—John J. Camby
*Assistant Examiner*—Larry I. Schwartz
*Attorney, Agent, or Firm*—Wegner, Stellman, McCord, Wiles & Wood

[57] ABSTRACT

An oven door construction including an improved oven door structure and method of forming the same wherein a plurality of viewing panel assemblies are mounted removably to door panel elements defining a hollow door through which air is conducted for cooling aligned front and rear viewing panels of the door construction. The front viewing panel assembly is pivotally mounted to the front panel of the door and may be readily removed therefrom upon removal of a small number of securing elements. The rear viewing panel assembly is mounted to the rear panel of the door and is readily removable therefrom upon separation of the door front and rear panels. The rear viewing panel assembly includes a plurality of mounting clip devices engaging opposed edge portions of the rear viewing panel to clamp the rear viewing panel therebetween. One mounting clip device in each opposing pair is movably mounted to a baffle wall of the rear viewing panel assembly for facilitated clamping of the rear viewing panel therebetween as the movable clip is tightened to the baffle wall. Threaded securing elements are provided for securing the rear viewing panel assembly to the rear door panel and the securing elements may be utilized to augment the clamping action of the movable mounting clip devices. The mounting of the front and rear viewing panel assemblies provides a facilitated manufacture as well as facilitated servicing of the oven door structure.

19 Claims, 10 Drawing Figures

OVEN DOOR CONSTRUCTION

BACKGROUND OF THE INVENTION

1. Field of the Invention

This invention relates to door constructions and in particular to oven door constructions and the like.

2. Description of the Prior Art

One improved form of oven door construction is disclosed in U.S. Pat. No. 3,877,460, of Larry C. Lotz et al, which patent is owned by the assignee hereof. The oven door disclosed therein is provided with an internal dead air space and an internal heat-absorbing black body baffle. The door construction includes means for inhibiting heat transfer both in the form of the dead air space and the heat-absorbing black body. As further disclosed, the viewing panels are defined by glass panes which are secured in the door by suitable structural elements and threaded securing means.

A number of devices have been developed for fastening panels and similar elements. Illustratively, in U.S. Pat. No. 1,027,397, Frederick B. Adam discloses a fastening device for panel board cabinets which comprises a U-shaped fastener having one leg engaging a flange on a box element for clamping the box element to a frame member.

George C. Weingardt, in U.S. Pat. No. 2,581,891, shows a window retaining means for securing a viewing window in a device, such as an electrically heated food roaster lid. The glass window is clamped to one edge portion of the lid defining the window opening. A clip is provided which is rotated to swing a retaining arm portion thereof beneath a flange of the glass to secure the glass in place across the window opening.

Howard B. Baughman et al, in U.S. Pat. No. 3,311,106, show a windowed oven door having complicated means for securing the viewing windows in the door construction. A shield is provided for covering the window during a high temperature operation of the oven.

In U.S. Pat. No. 2,536,956 of Herbert M. Reeves, an oven door construction is disclosed wherein the window pane is mounted to the door panel by a plurality of corner clips having openings through which the corners of the window pane extend so as to be embraced by the clips. The clips are applied to the door while in a flat condition and are bent back to effect the engagement with the pane corners.

A number of different window constructions are illustrated in U.S. Pat. Nos. 2,637,879 of Edward C. Mueller and 3,152,369 of Alvin H. Gottesleben. In these patents, means are provided for releasably clamping the edge portion of a window pane for mounting the pane in a sash, or the like.

SUMMARY OF THE INVENTION

The present invention comprehends an improved oven door construction and method of forming the same wherein the viewing panel assemblies are readily removably installed in the front and rear door panels.

The door construction defines a vertical air flow passage between the front and rear door panels and viewing panel assemblies carried thereon for effecting a continual air washingcooling action by ambient air flow through the door.

The invention comprehends an arrangement of the front viewing panel assembly such as to deflect the cooling air flow rearwardly toward the rear viewing panel assembly for improved cooling action.

The viewing panel assemblies may be pivotally mounted to the door panels for facilitated installation and servicing. The front viewing panel assembly may be pivotally mounted to the front door panel and secured in the installed arrangement by a small number of screws which, when removed, permits the pivoting of the front viewing panel assembly forwardly so as to permit facilitated withdrawal of the assembly from the door panel.

In the illustrated embodiment, the front viewing panel assembly grips a flange portion of the front door panel portion defining the bottom of the front window opening between a mounting frame portion of the front viewing panel assembly and a plurality of spring clips secured thereto by securing means. The securing means may further secure a retaining frame to the mounting frame to secure the edge portion of the viewing panel in a recess within the mounting frame.

In the illustrated embodiment, the rear viewing panel assembly comprises a baffle panel including a flange portion defining a viewing opening. The viewing panel may rest on the flange of the baffle panel, and clips are provided which are arranged in opposing pairs attached to the baffle panel adjacent upper and lower edges of the window opening. The clips adjacent one edge of the window are rigidly fastened to the baffle panel, and the opposing clips adjacent the other edge of the window opening are each movably attached to the baffle panel with fastening means such as screw fasteners. As each movable clip is tightened, the torque applied to the fastener is also transmitted to the clip, and the clip is thus moved into engagement with an edge portion of the viewing panel so that the viewing panel is tightly clamped between opposing clips.

The rear viewing panel assembly may then be attached to the rear door panel by using fastening means to connect the rear door panel to the fixed and movable clips, and torque applied to the fastening means for this purpose is partially transferred to the movable clips to further ensure a tight clamping of the rear viewing panel between the opposed fixed and movable clips. Attachment of the rear door panel to the rear viewing panel assembly also clamps the viewing panel between the flange of the baffle panel and a corresponding flange of the rear door panel, and sealing means may be provided on the rear door panel flange to prevent the passage of air past the viewing panel and into the door.

Thus, broadly, the invention comprehends an improved oven door construction wherein the viewing window assemblies are mounted in the door in a new and improved manner for facilitated installation and servicing. The assembly of the door construction is extremely simple and economical while yet providing the highly desirable features discussed above.

BRIEF DESCRIPTION ON THE DRAWING

Other features and advantages of the invention will be apparent from the following description taken in connection with the accompanying drawing wherein.

DESCRIPTION OF THE PREFERRED EMBODIMENT

Figure 1:
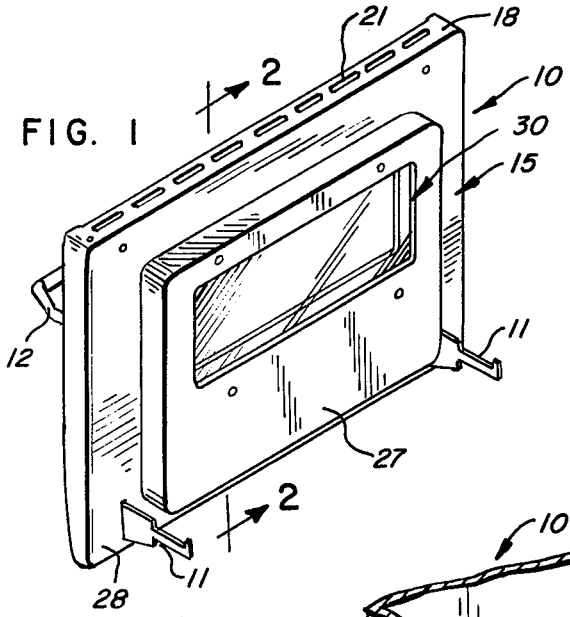
FIG. 1 is a rear perspective view of an oven door construction embodying the invention.
Figure 5:
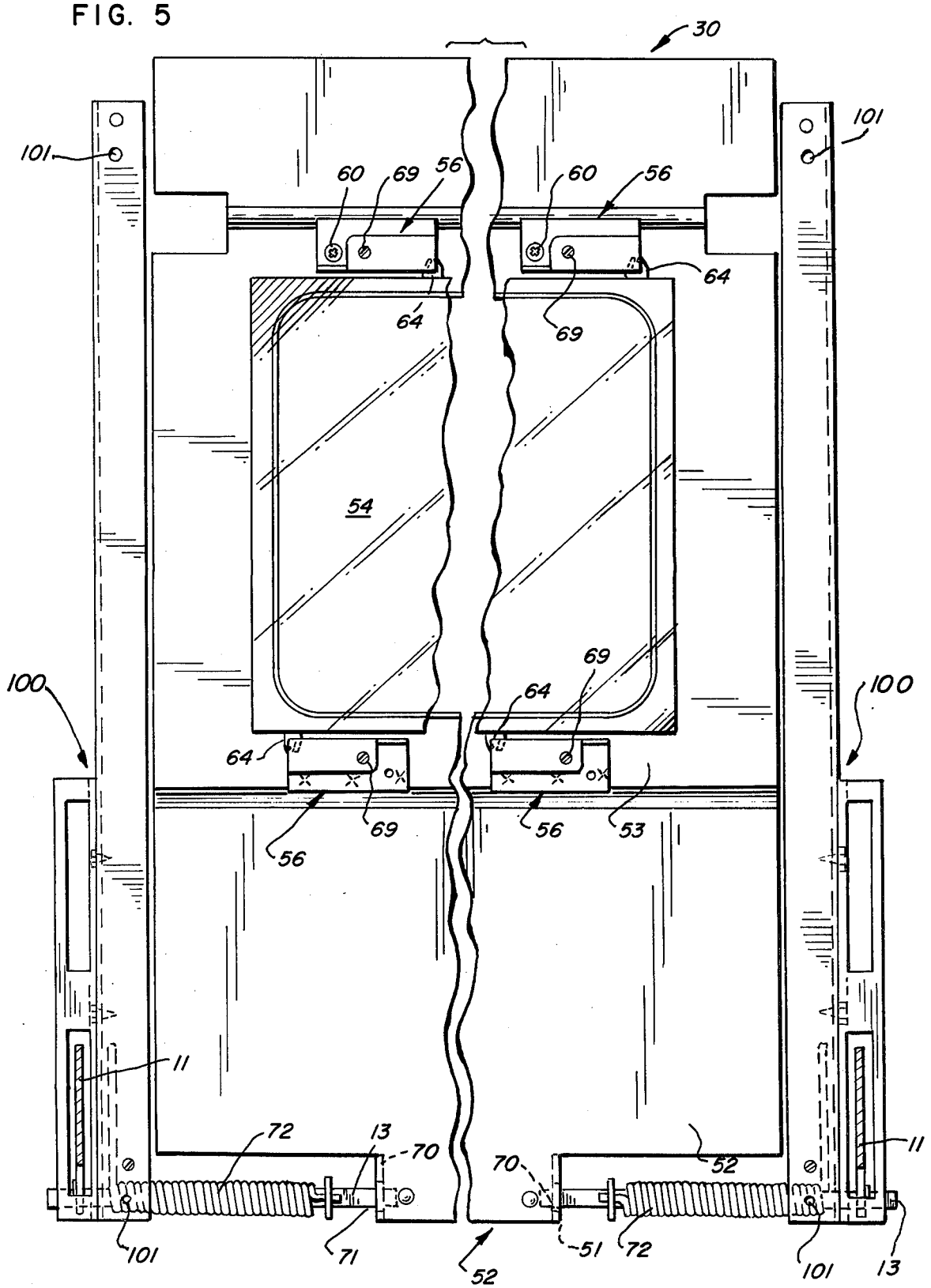
FIG. 5 is a fragmentary vertical section showing the construction of the rear viewing panel assembly mounting means.

In the exemplary embodiment of the invention as disclosed in the drawing, a door structure generally designated 10, illustratively comprises an oven door structure suitable for use in a conventional domestic range oven. As shown in FIG. 1 of the drawing, the door structure includes a pair of rearwardly extending mounting arms 11 adapted to be removably engaged with mounting structure on the oven cabinet (not shown). The door structure may be provided with a front handle 12 for manually swinging the door about a pivotal axis defined by the inner end of the arms 11. More specifically, as shown in FIGS. 2 and 5, each of the arms is provided with an inwardly projecting pivot rod 13 and a biasing spring 72 coaxially surrounding the rod and biasing the door relative to the arms 11.

The present invention comprehends an improved construction of the oven door structure 10 which provides simplified and facilitated assembly and servicing. More specifically, the oven door structure includes a front panel 14 and a rear panel 15. The front panel is provided with an inturned peripheral flange 16 and the rear panel is provided with an inturned peripheral flange 17, which, as shown in FIG. 2, are secured in interfitted relationship by suitable screws 18 to define a hollow door construction. Top portion 19 and bottom portion 20 of flange 16 may be provided with suitable openings 21 and 22, respectively, for providing a vertical air flow through the hollow door for effecting desirable cooling thereof as during use of the associated oven.

Figure 2:
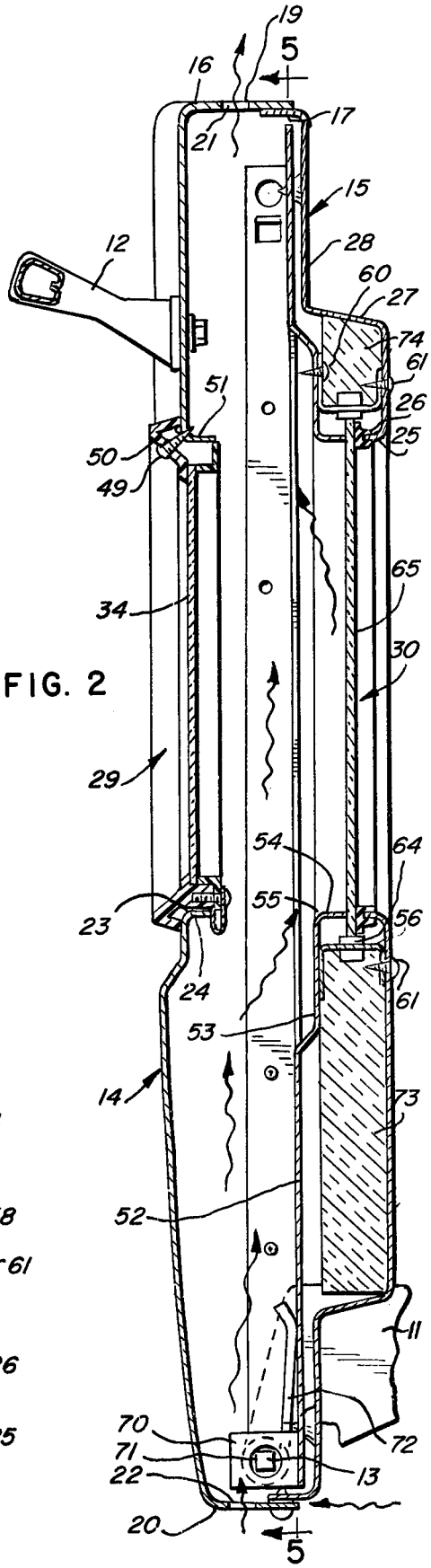
FIG. 2 is a vertical section taken substantially along the line 2—2 of FIG. 1.

As further seen in FIG. 2, the front door panel 14 is provided with a window opening 23 defined by a rearwardly turned flange 24. The rear door panel 15 is provided with a window opening 25 defined by a forwardly turned flange 26. Door panel 15 may be provided with a midportion 27 which extends rearwardly from the peripheral portion 28.

The door structure is provided with a front viewing panel assembly generally designated 29 extending across window opening 23 of front door panel 14, and a rear viewing panel assembly generally designated 30 extending across window opening 25 of the rear door panel 15. As shown in FIG. 2, the viewing panel assemblies are in aligned relationship to provide a see-through door arrangement.

As best seen in FIGS. 6–9, the front viewing panel assembly 29 includes a mounting frame 31 which is generally coextensive with the window opening flange 24. The mounting frame defines a central viewing panel opening 32 and a rearwardly opening recess 23. A transparent viewing panel 34, which illustratively may comprise a sheet of glass, extends across the window opening 32 to have a peripheral portion 35 received in recess 33.

The viewing panel is secured in the recess by a retainer frame 36 having a rear portion 37 secured to the mounting frame by suitable means, such as screws 38. The retainer frame includes a forwardly turned flange 39 arranged to abut the peripheral portion 35 of the viewing panel glass 34 and thereby firmly secure the viewing panel in the assembly 29.

Figure 7:
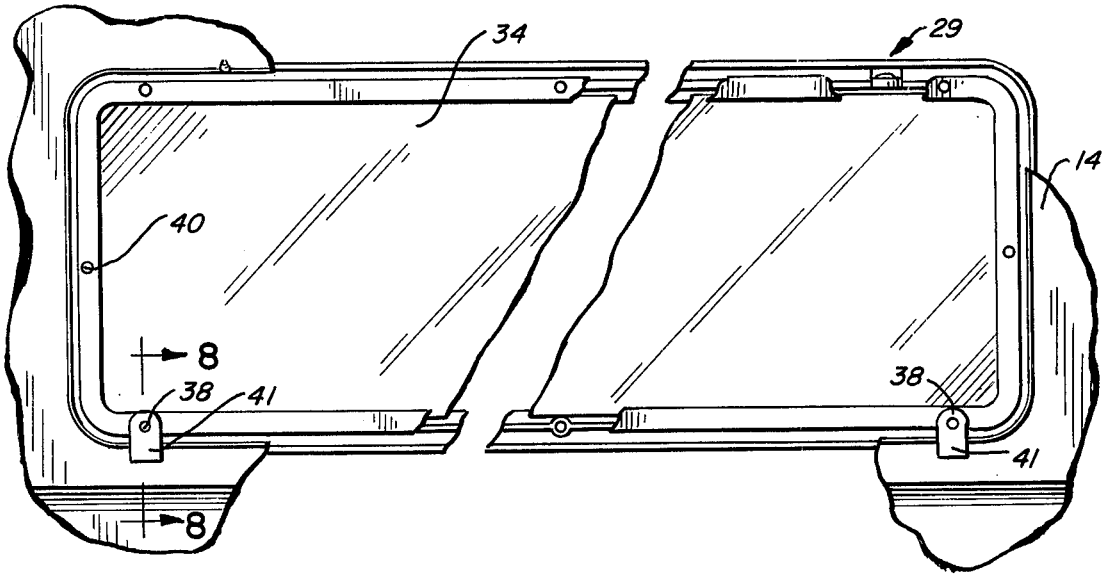
FIG. 7 is a fragmentary rear elevation of the assembled front door panel and front viewing panel assembly.

As shown in FIG. 7, the retainer frame may be further secured to the mounting frame by an additional plurality of screws 40.

Figure 8:
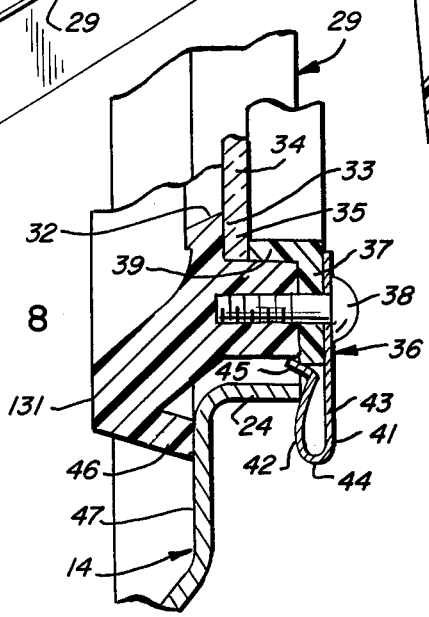
FIG. 8 is a fragmentary enlarged vertical section taken substantially along the line 8—8 of FIG. 7.

A pair of spring clips 41 at the opposite ends of the assembly are mounted to the assembly by the screws 38, as best seen in FIG. 7. As shown in FIG. 8, each spring clip comprises a U-shaped body formed of a suitable springy material, such as metal, including a front leg 42, a rear leg 43, and an interconnecting bight portion 44. The distal end of the front leg 42 is provided with a forwardly turned flange 45 which is adapted to prevent travel of the inturned flange 24 of door panel 14 above the end of the clip. The mounting frame 31 is provided with a rearwardly turned outer flange 46 which abuts the front surface 47 of the door panel 14 about the window opening 23 and, thus, the lower end of the front viewing panel assembly 29 is retained on the door panel flange 24 and is generally pivotable thereon, the rearwardly turned outer flange 46 cooperating with the leg 42 of the clip to define a space for receiving the flange 24 of the bottom side of the window opening 23 in a gripping manner.

As already stated, screws 38 may be utilized to secure the rear leg 43 of the spring clip to the mounting frame 31, with the screw shank extending through the spring clip leg 43 and the retainer frame portion 37 for concurrently securing securing both elements to the mounting frame.

Figure 6:
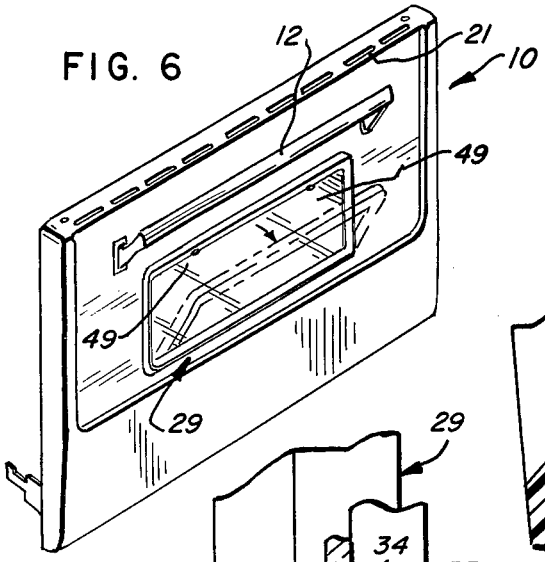
FIG. 6 is a front perspective view of the oven door construction.

As shown in FIG. 6, the upper portion 48 of the mounting frame 31 may be secured to the front door panel 14 by suitable screws 49. As shown in FIG. 2, screws 49 extend through a double portion 50 of the mounting frame into a corner portion 51 of the front panel 14 from which the flange 24 rearwardly extends. As shown in FIG. 6, two such screws 49 may suffice for securing the front viewing panel assembly 29 in the door structure, thereby providing facilitated assembly and servicing when desired.

In the embodiment disclosed, a small vertical clearance is provided between the front viewing panel assembly 29 and the window opening 23. This clearance allows the assembly 29 to be moved vertically with the screws 29 removed and facilitates tilting of the assembly 29 during installation or removal.

Figure 9:
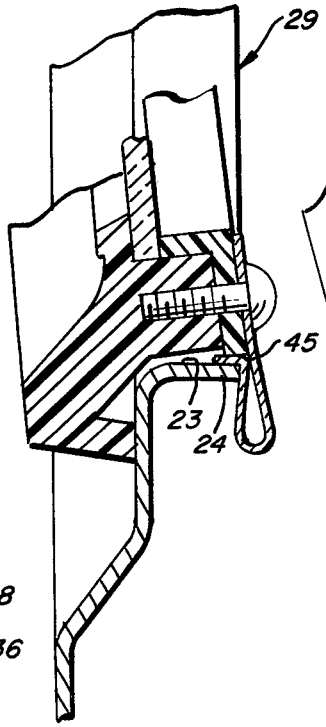
FIG. 9 is a fragmentary enlarged section similar to that of FIG. 8 but with the front viewing panel assembly disposed in a partially removed arrangement.
Figure 10:
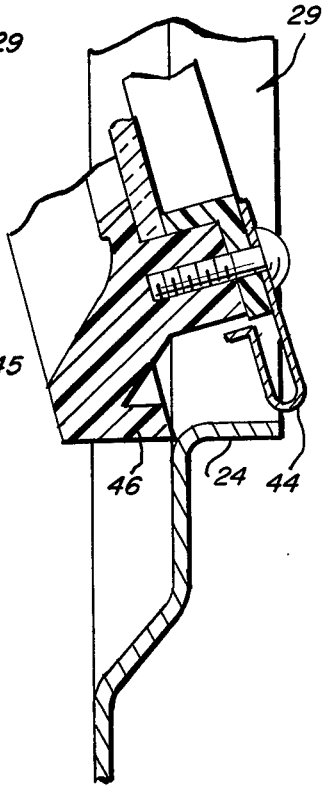
FIG. 10 is a fragmentary enlarged section similar to that of FIG. 9 but with the front viewing panel assembly disposed in a further removed arrangement.

More specifically, as shown in FIG. 9, the front viewing panel assembly 29 may be removed from the front door panel window 23 by removal of the screws 49 followed by a slight downward movement with a concurrent forward tilting of the assembly. Leg 42 of the spring clip cooperates with flange 46 at this time to retain door flange 24 after screws 49 have been removed. Once the viewing panel assembly has been moved downwardly and tilted forewardly to the arrangement of FIG. 9, the viewing panel assembly may be removed by a simple forward and upward withdrawal movement whereby the spring clip and the cooperating flange 46 are moved out of their retaining relationship with the flange 24 as the panel assembly 29 is moved away from the door flange 24, as shown in FIG. 10.

Upon removal of the viewing panel assembly 29 from the door, the elements thereof may be readily disassembled by the simple removal of screws 38 and 40. Reassembly of the panel assembly 29 may be effected by a simple reversal of the above described operations.

The construction of the rear viewing panel assembly 30 is best seen in FIGS. 2–5. As shown therein, the assembly 30 includes a front baffle panel 52 having a rearwardly recessed midportion 53 provided with a central window opening 54 defined by a rearwardly turned flange 55.

Figure 4:
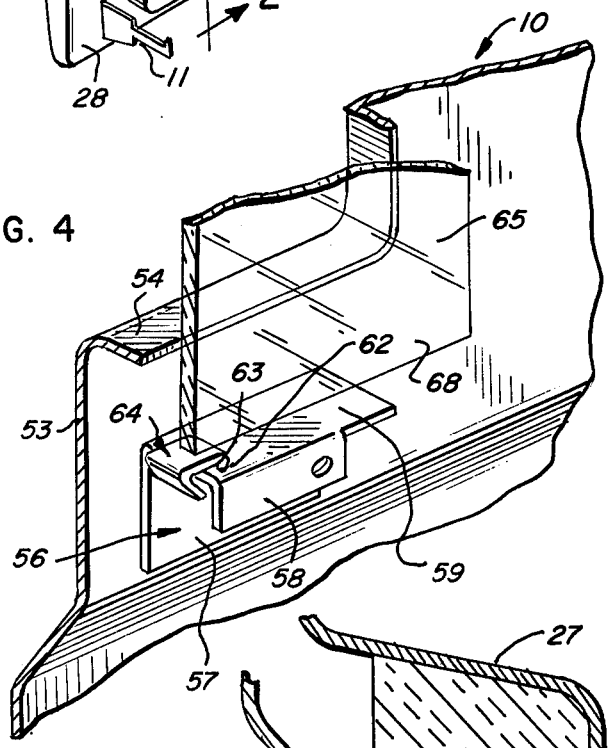
FIG. 4 is a fragmentary perspective view thereof.
Figure 3:
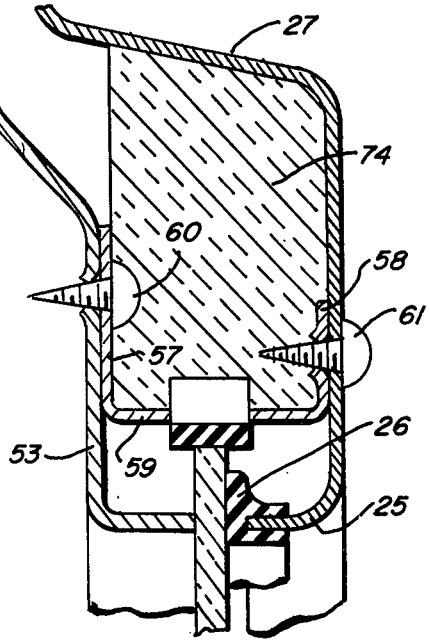
FIG. 3 is a fragmentary enlarged vertical section illustrating the mounting of the rear viewing panel in the oven door construction.

The baffle panel 52 is removably secured to the rear door panel 15 by a plurality of mounting clips generally designated 56. As best seen in FIGS. 3 and 4, each mounting clip comprises a U-shaped element having a front flange 57, a rear flange 58, and a bight portion 59. The front leg, or flange, 57 of each clip is secured to the baffle wall portion 53, by a screw 60 in the case of each of the upper clips, and in the case of each of the lower clips, by spot welding or similar fixed fastening means. The rear leg of each clip is secured to the midportion 27 of the rear panel 15 by a screw 61.

As best seen in FIGS. 3 and 4, the bight portion 59 of each mounting clip is spaced from the inturned flange 55 of the baffle panel. The bight portion is provided with a slot 62 for receiving one leg 63 of a U-shaped resilient bumper 64 which, as shown in FIG. 4, is thusly arranged to straddle one end of the mounting clip 56.

As shown in FIG. 5, in the illustrated embodiment, four such mounting clips 56 having bumpers 64 carried thereon are provided on the baffle panel. As shown, the clips are provided in paired opposed relationship with each welded or otherwise rigidly attached clip opposed to a corresponding movable (rotatable as shown in FIG. 5) clip attached to baffle 52 by a screw 60. Of course, once the screw 60 has been secured tightly in place, the movable clips will no longer be movable under normal usage so long as the screws 60 remain tight.

A viewing panel 65 is first placed over the window opening 54 defined in the recessed portion 53 of panel 52 and allowed to rest on rearwardly turned flange 55 thereof. The viewing panel 65, which may be formed of a suitable transparent material, such as tempered glass, is then clamped between the bumpers 64 of the opposing clips 56.

The improved positive clamping of the viewing panel 65 in the panel assembly 30 is accomplished as follows. With the panel 65 resting on flange 55 of the panel 52, the lower edge of the panel 52 is adjacent the bumpers 64 associated with the clips fixedly mounted to the panel 52, as best seen in FIG. 5, Similarly, the movable clips are located on panel 52 with their bumpers 64 adjacent the upper edge of the panel 65. As each screw 60 is tightened to fasten its respective movable clip 56 to the panel 52, some of the tightening torque applied to the screw (in a clockwise direction, as seen in FIG. 5) will be transferred to the associated clip so that the clip will be rotated in a clockwise direction, thereby clamping the glass between bumpers of opposing fixed and movable clips. When each screw 60 has been tightly fastened, the movable clips will be held tightly in place and the panel 65 will be tightly held between opposing clips.

With continuing reference to FIG. 5, a hole 69 in each mounting clip for receiving the screw 61 is disposed also at the end of the mounting clip opposite the bumper 64 so that subsequent clockwise tightening of each screw 61 into hole 69 of each movable clip effects a further positive clamping action of the bumpers against the glass edge. As shown in FIG. 3, the inturned flange 26 of the rear door panel 15 is provided with a sealing element 66 to be compressed against the rear surface 67 of the window glass 65 whereby the peripheral portion 68 of the window glass is further clamped between the seal 66 and the baffle wall flange 55.

In initially assembling the door structure according to the present invention, the baffle panel 52 is first placed with its front surface facing downwardly in a suitable fixture (not shown). A pair of mounting arm assemblies 100 are placed in the fixture with one mounting arm assembly positioned on each side of baffle 52, as best seen in FIG. 5. The pivot rod 13 of each mounting arm assembly is positioned with its distal end extending through an opening 71 of an adjacent inwardly extending flange 70 of the baffle 52, the baffle 52 defining a pair of such flanges 70 which each receive a different rod 13. The rear window assembly is then completed by clamping the rear glass panel to the baffle 52 between clips 56 as already described.

Pieces of insulation 73 and 74 (see FIG. 2) are then positioned on baffle 52 above and below the window opening 54. The rear door panel 15 is placed over the rear viewing panel assembly 30 and the mounting arm assemblies 100, and the four screws 61 are threaded into the holes 69 to fasten the door panel 15 to the viewing panel assembly 30. At the same time, additional screws are driven through the door panel 15 into holes 101 in the mounting arm assemblies 100 to fasten the mounting arm assemblies to the door panel 15.

After handle 12 has been attached to the front panel 14, the front panel 14 is attached to the rear panel 15 with the screws 18, and the front viewing panel assembly 29 is mounted on the front panel 14 as previously described to complete the assembly of door structure 10.

Thus, synergistically, the baffle wall 52 is secured to the rear door panel by the screws 60 and 61, and mounting clip 56, so as to provide a support for the distal ends of the pivot rods 13.

With the door removed from the oven, as shown in FIG. 1, the rear door panel 15 may be separated from the front door panel 14 by the removal of screws 18. Subsequent removal of screws 61 permits the rear viewing panel assembly to pivot on the rods 13 away from the rear door panel. Counterclockwise movement of the movable mounting clips 56 may then be effected by suitable loosening of the screws 60 to permit withdrawal of the viewing panel 65, for cleaning, or replacement, as desired.

As shown in FIG. 2, insulation, such as the pieces of fiberglass insulation 73 and 74, may be provided within the rearwardly projecting midportion 27 of the rear door panel for minimizing heat transfer through the door. As discussed above, the flow of cooling air through the hollow door between the front and rear viewing panel assemblies effects a cooling thereof for maintained low temperature of the exposed front door panel 14. As shown in FIG. 2, the rearwardly projecting arrangement of the front viewing panel assembly 29 in the front door panel opening 23 defines a deflecting means for causing a portion of the cooling air flow to be deflected rearwardly against the rear viewing panel 65 for further improved cooling of the door structure in normal operation.

Door structure 10 is extremely simple and economical of construction, with the viewing panel assemblies thereof being readily installed and removed for servicing when desired. The novel mounting of the viewing panel assemblies provides facilitated manipulation thereof during the servicing operations.

The foregoing disclosure of specific embodiments is illustrative of the broad inventive concepts comprehended by the invention.

I claim:

1. An oven door structure comprising:

a front panel having a window opening;

a rear panel having a rearwardly recessed window opening;

panel securing means for securing said panels in parallel spaced relationship with said window openings aligned and defining an air flow space therebetween;

means for providing a cooling air flow through said space; a front viewing panel assembly having a front light transmitting viewing panel;

front viewing panel assembly securing means removably swingably mounting said front viewing panel assembly to said front panel to cause said front viewing panel to extend across said front panel window opening, said front viewing panel assembly having frame means extending rearwardly into said space;

a rear viewing panel assembly having a rear light transmitting viewing panel; and rear viewing panel assembly securing means for readily removably securing said rear viewing panel assembly to said rear panel to extend across said rearwardly recessed rear panel window opening, said front viewing panel assembly frame means being spaced fully forwardly of said rear viewing panel assembly whereby said air flow space is effectively unobstructed between said frame means and said rear viewing panel assembly, said frame means defining means for causing a portion of the cooling air flow to be deflected rearwardly to the recessed rear viewing panel for effective cooling of the rear viewing panel assembly notwithstanding the recessed disposition thereof, the air flow space having substantially maximum width between said viewing panels.

2. The oven door structure of claim 1 wherein said front viewing panel assembly securing means comprises a small number of screws.

3. The oven door structure of claim 1 wherein said front viewing panel assembly securing means comprises two screws.

4. The oven door structure of claim 1 wherein said means for securing said rear viewing panel assembly includes pivot means for pivotally mounting said rear viewing panel assembly to said rear panel for selective disposition in an access portion for servicing said rear viewing panel assembly when desired.

5. The oven door structure of claim 1 wherein said means for securing said front panel viewing assembly includes pivot means for pivotally mounting said front viewing panel assembly to said front panel for selective disposition in an access portion for servicing said front viewing panel assembly when desired.

6. The oven door structure of claim 1 wherein said means for securing said front panel viewing assembly includes pivot means for pivotally mounting said front viewing panel assembly to said front panel for selective disposition in an access portion for servicing said front viewing panel assembly when desired, said pivot means being arranged to permit pivoting of the front viewing panel assembly forwardly from said front panel for servicing thereof while maintaining secured relationship of said front and rear panels by said panel securing means.

7. In an oven door having a front panel provided with a window opening, an improved viewing panel assembly comprising:

a mounting frame having a front flange defining a viewing panel opening, and a recess opening rearwardly of said flange;

a viewing panel extending across said viewing panel opening and having a peripheral edge received in said recess;

a retainer frame having a securing portion overlying said mounting frame about said recess opening, and a retaining portion extending into said recess into abutment with said viewing panel therein;

a spring clip having a U-shaped body including a front leg, a rear leg, a bight portion connecting said legs, and a forwardly turned end on said front leg adapted to overlie said front panel at the bottom of the window opening;

spring clip securing means for securing said spring clip to said mounting frame; and viewing panel assembly securing means for securing the viewing panel assembly in said front panel window opening, the viewing panel assembly being supported pivotally at said bottom of the window opening by said spring clip upon removal of said securing means to facilitate installation and removal of the viewing panel assembly.

8. The oven door of claim 7 wherein said viewing panel assembly securing means comprises threaded means accessible from the front of said front panel for securing the viewing panel assembly against pivot movement on said spring clip means.

9. The oven door of claim 7 wherein said spring clip securing means further comprises means for securing said retainer frame to said mounting frame.

10. The oven door of claim 7 wherein said mounting frame comprises a molded synthetic resin frame.

11. The oven door of claim 7 wherein said spring clip securing means comprises threaded securing means extending through said spring clip rear leg and said retainer frame to secure the spring clip in abutment with said retainer frame and the retainer frame in abutment with said mounting frame.

12. In an oven door having a rear panel provided with a window opening, an improved viewing panel assembly comprising:

a baffle panel defining a viewing panel opening;

baffle panel mounting means mounting said baffle panel to the rear panel with the viewing panel opening aligned with the rear panel window opening;

a plurality of mounting clip means;

clip mounting means for mounting said clip means to said baffle panel adjacent said viewing panel opening at spaced portions thereof;

a viewing panel extending between said mounting clip means across said viewing panel opening, at least one of said means for mounting said mounting clip means comprising pivotal mounting means for adjustably clamping the viewing panel edgewise between said clip means with the clip means being hidden behind said baffle panel adjacent said viewing panel opening; and sealing means carried by the rear panel for sealing the viewing panel to the rear panel about said window opening.

13. The oven door structure of claim 12 wherein said baffle panel mounting means comprises means for removably mounting the baffle panel to the door rear panel.

14. The oven door structure of claim 12 wherein each said mounting clip means includes a mounting element and resilient means on the mounting element yieldably engaging an edge portion of the viewing panel.

15. The oven door structure of claim 12 wherein each said mounting clip means includes a mounting element and resilient means removably carried on the mounting element yieldably engaging an edge portion of the viewing panel.

16. The oven door structure of claim 12 wherein said clip mounting means include a plurality of pivotal mounting means.

17. The oven door structure of claim 12 wherein said baffle panel mounting means comprises means for removably mounting the baffle panel to the door rear panel, said mounting clip means being movably mounted to said baffle panel whereby the viewing panel may be removed from the assembly by moving said baffle panel away from said door rear panel to provide accessibility to said mounting clip means, and subsequently adjusting said pivotal mounting clip means to release the viewing panel.

18. The oven door structure of claim 12 wherein said baffle panel includes a rearwardly turned flange defining said baffle panel window opening, said viewing panel being clamped between said flange and said sealing means.

19. The oven door structure of claim 12 wherein said mounting means include a plurality of U-shaped clips have a rear leg, a front leg and a bight portion, and resilient means carried by said bight portion engaging said viewing panel edge portions.

* * * * *